United States Patent [19]

Thievessen

[11] Patent Number: 4,895,314

[45] Date of Patent: Jan. 23, 1990

[54] DEVICE FOR UNWINDING A WEB OF MATERIAL FROM A REEL

[75] Inventor: Karl Thievessen, Grevenbroich, Fed. Rep. of Germany

[73] Assignee: Jagenberg Aktiengesellschaft, Dusseldorf, Fed. Rep. of Germany

[21] Appl. No.: 186,338

[22] Filed: Apr. 26, 1988

[30] Foreign Application Priority Data

May 8, 1987 [DE] Fed. Rep. of Germany ..... 3715475

[51] Int. Cl.[4] ..... B65H 19/10

[52] U.S. Cl. ..... 242/58.6; 242/68.4

[58] Field of Search ..... 242/58.6, 68.4, 65, 242/54 R, 79; 414/749–751, 911

[56] References Cited

U.S. PATENT DOCUMENTS

| | | | |
|---|---|---|---|
| 2,973,914 | 3/1961 | Beninger et al. | 242/58.6 |
| 2,991,953 | 7/1961 | Moser et al. | 242/58.6 X |
| 3,057,571 | 10/1962 | Aaron et al. | 242/58.6 |
| 3,175,779 | 3/1965 | Grobman et al. | 242/58.6 |
| 3,276,711 | 10/1966 | Martin | 242/58.6 |
| 3,321,147 | 5/1967 | Martin | 242/58.6 |

FOREIGN PATENT DOCUMENTS

| | | |
|---|---|---|
| 2951336 | 7/1981 | Fed. Rep. of Germany . |
| 8511936 | 3/1986 | Fed. Rep. of Germany . |

*Primary Examiner*—Joseph J. Hail, III
*Assistant Examiner*—Steven M. duBois
*Attorney, Agent, or Firm*—Sprung Horn Kramer & Woods

[57] ABSTRACT

A device for unwinding a web of material from a reel. It has two supporting arms that are positioned separated and extending across the web, that can be pivoted up, and that can accommodate and hold the reel in such a way that it can be rotated. To improve a generic device to the extent that it will be simple in design and take up little space, the pivoting bearings for the supporting arms are moved between two positions that extend horizontally and mutually displaced across the axis of rotation.

5 Claims, 4 Drawing Sheets

DEVICE FOR UNWINDING A WEB OF MATERIAL FROM A REEL

BACKGROUND OF THE INVENTION

The invention concerns a device for unwinding a web of material from a reel, with two supporting arms that are positioned separated and extending across the web, that can be pivoted up, and that have means of accommodating and holding the reel in such a way that it can be rotated.

Devices of this type are intended especially for unwinding webs of paper in the paper-processing industry.

The reels of paper that are to be unwound are suspended between the supporting arms and lifted for unwinding a web of paper that is wound on a core tube is to be unwound without a shaft, two expanding chucks that rotate on the arms are introduced into the openings on each side of the tube. Unwinding devices of this type are described in German No. GM 8 511 986 and OS 2 951 336 for example.

When the reels are changed, fresh reels are usually supplied by means of under-the-floor conveyors that advance them into the pick-up range of the chucks, which can be separated and lowered in order to accept the reel. When several reels distributed along the direction that the web is traveling in are to be unwound, it is practical, in order to accelerate changing the reels, to introduce the new reels from the side, across the direction of travel. When the arms of the devices are secured in lateral uprights, enough space must be left between the unwinding stations because the uprights get in the way of lateral loading and the reels must also be advanced along the direction of travel to position them within the range of the chucks.

In order to eliminate the need for this additional motion and to attain a space-saving design, the supporting beams in the generic device described in German No. GM 8 511 986, which are suspended in a stand, are pivoted up on the loading side to allow a fresh reel to be introduced. The beams pivot up into a vertical position to accommodate the fresh reel, and the arms are subsequently shortened in order to lift the reel. There is a drawback to this device in that all the forces must be transmitted by horizontal supporting components of the stand, which must accordingly be very heavy to attain the requisite stability.

Also known are devices in which the supporting arms move up and down vertically on uprights and can also be pivoted up to introduce a fresh reel. The arms, which are separated more or less horizontally, travel vertically in the uprights for lifting into the unwinding position. This demands expensive perpendicular channeling of the arms in the lateral uprights.

SUMMARY OF THE INVENTION

The object of the invention is to improve a generic device to the extent that it will be simple in design and take up little space.

This object is attained by the improvement wherein the pivoting bearings for the supporting arms can be moved between two positions that extend horizontally and are mutually displaced across the axis of rotation.

Since the reel can be lifted into the unwinding position in a pivoting motion in accordance with the invention, no expensive vertical channeling system will be necessary. Since the reel-accommodation mechanisms can also move horizontally at the ends of the supporting arms, the fresh reel will not have to be positioned across its axis while the reels are being changed. The principle not only saves space but also simplifies the design because the arms can be supported against the floor while they pivot up.

Another advantage is that, since the arms can be adjusted more or less perpendicularly in the unwinding position, the torsion on the axes of rotation can be considerably decreased. The components that impede the pivoting of the arms will accordingly be considerably less subject to stress during subsequent readjustments of the unwinding position.

The device can have traveling pivoting bearings that rest on the floor.

The supporting arms can be secured non-rotatingly to a rotating shaft that parallels the axis of rotation of the reel and that can be advanced horizontally across that axis.

The shaft can have lateral casters and can rotate on one side of a carriage that can be advanced by means of a drive mechanism.

The device can have a pivoting lever secured to the shaft and pivoted by a drive mechanism.

If the device has an advance-drive mechanism on one side, it can have a synchronizing mechanism to ensure a uniform advance of the shaft parallel to the axis of the reel.

The horizontal motion of the pivoting bearing in the embodiments just described derives from the supporting arms being mounted in such a way that they can pivot up in a structure that travels along the floor.

In another embodiment of the invention, each supporting arm can pivot up on a lever that is articulated at the other end to an upright.

Finally, the device can have supporting arms that are separated across the web to an extent that can be varied.

BRIEF DESCRIPTION OF THE DRAWINGS

The invention will now be specified with reference to the drawings, wherein.

DETAILED DESCRIPTION OF THE INVENTION

Figure 1:
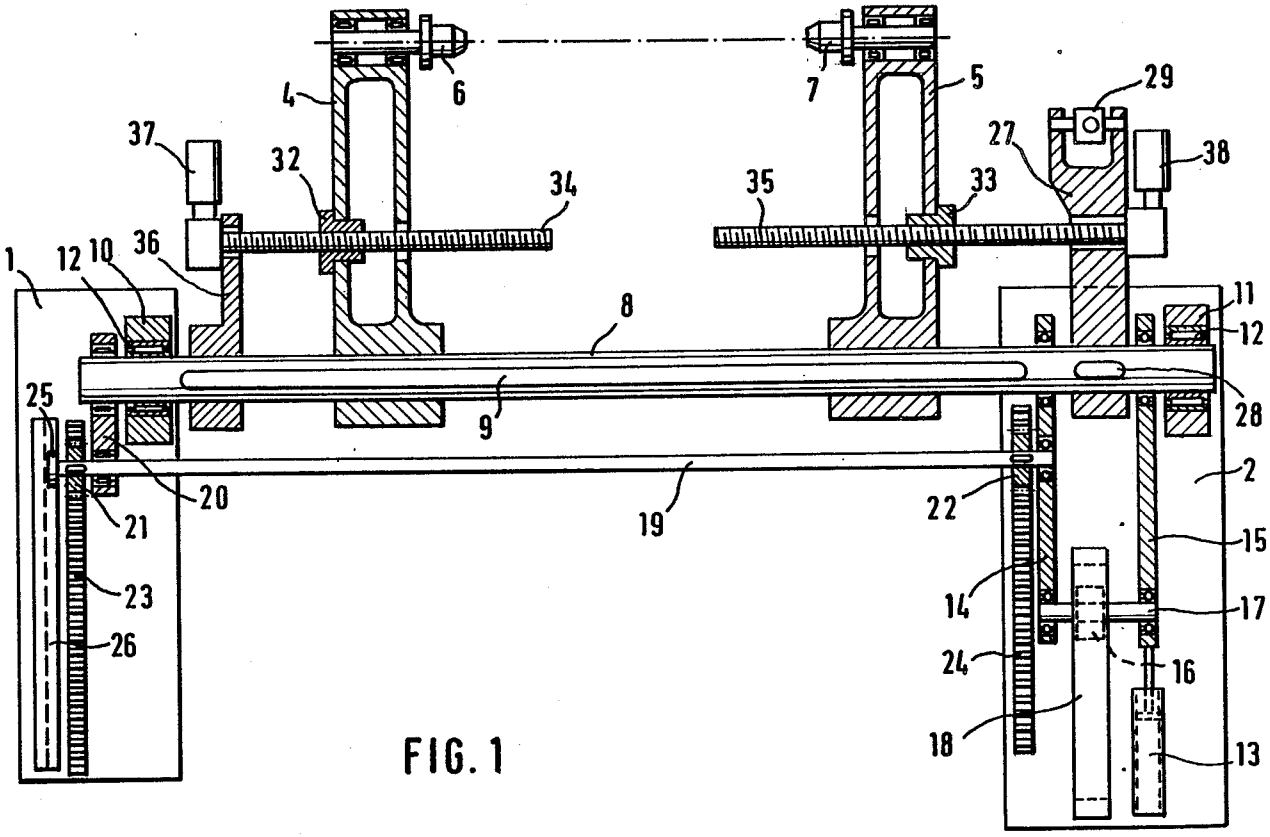
FIG. 1 is a section through a traveling device wherein the supporting arms are pivoted 90° out of the unwinding position for the purpose of clearer illustration.
Figure 2:
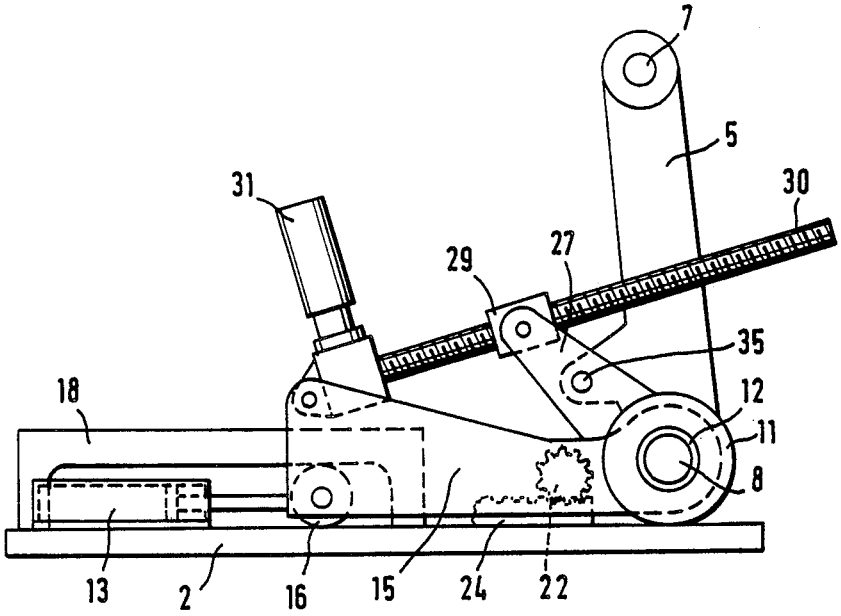
FIG. 2 is a side view of the device in FIG. 1 with the supporting arms pivoted up.

The device in accordance with the invention illustrated in FIGS. 1 and 2 extends across the axis of the reel that is to be unwound, rests on two horizontal base plates 1 and 2 that are separated by longer than the maximum width of the reel, and can be advanced back and forth, from left to right and back again in FIG. 2.

The device features two supporting arms 4 and 5 with two facing expandable chucks 6 and 7 that accommodate a reel. Arms 4 and 5 slide back and forth on a shaft 8, on which they are prevented from rotating by a spline 9. Shaft 8 has a freely rotating caster 10 and 11 on each end, on which it can be advanced back and forth on base plates 1 and 2. The bearings 12 for shaft 8 in casters 10 and 11 are simultaneously the bearings that supporting arms 4 and 5 pivot on. This motion is governed by a drive mechanism at one side (the right in FIG. 1) of base plate 2.

The drive mechanism consists of a piston-and-cylinder unit 13 that is secured on the one hand to base plate 2 and on the other to a traveling carriage. The carriage is composed of two parallel sides 14 and 15, through one end of which shaft 8 extends parallel to the axis of the reel and rotates freely in such a way that the carriage rests on shaft 8. The other end of the carriage rests on a roller 16 that itself rests on a shaft 17 and travels between sides 14 and 15 and between a rail 18 and base plate 2. An electric motor and chain could also be employed as a drive mechanism 13 instead of a piston-and-cylinder unit.

To ensure that the device will operate exactly the same on both sides, it contains a synchronization mechanism consisting of a synchronization shaft 19 that extends across the operating width and rotates on the intake side in side 14 and on the other side in a connecting plate 20 suspended at the end of shaft 8. At each end of synchronization shaft 19 is a pinion 21 and 22, each of which engages a rack 23 or 24 secured to its respective base plate 1 or 2. Secured to the outermost end of synchronization shaft 19 and behind connecting plate 20 is a wheel 25 that travels in a rail 26 with a U-shaped cross-section, ensuring the engagement of pinion 21 with rack 23. Lantern gears or chains could be employed instead of racks 23 and 24.

Instead of only one advance mechanism and one synchronization mechanism it is also possible to employ a separate system on each side, with their motions synchronized.

To pivot supporting arms 4 and 5 up and down, a lever 27 is mounted on shaft 8 between sides 14 and 15 and prevented from rotating on the shaft by means of a spline 28. At the other end of pivoting lever 27, a spindle nut 29 rotates in a fork around an axis that parallels shaft 8. Extending through nut 29 is a threaded spindle 30, which is driven by a motor 31 that rotates on sides 14 and 15 above roller 16. Motor 31 pivots lever 27, rotating shaft 8, and the supporting arms 4 and 5 mounted on the shaft pivot along. Instead of a spindle mechanism 29 and 30 driven by a motor 31, it would also be possible to employ a hydraulic piston-and-cylinder unit.

The distance between expanding chucks 6 and 7 can be varied to accept and a fresh reel and to accommodate reels of different widths. There is a spindle nut 32 and 33 for this purpose in each supporting arm 4 and 5, with a threaded spindle 34 or 35 extending out through it parallel to shaft 8. The spindle 34 on arm 4 is mounted outside in a lever 36 secured to shaft 8 and driven by a motor 37. The spindle 35 on arm 5 is mounted outside in lever 27 and is powered by a motor 38 secured to the lever.

How the device in accordance with the invention functions will now be described with reference to FIGS. 3 through 6.

Figure 3:
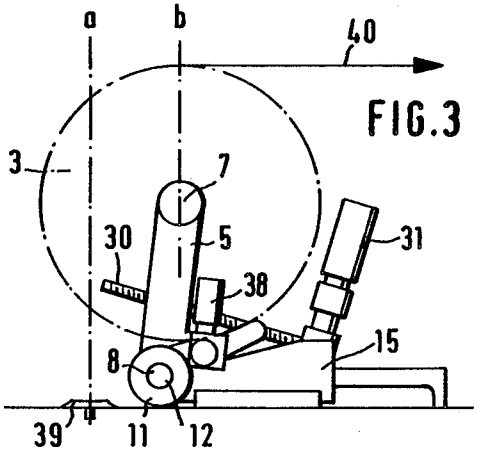

FIG. 3 shows the unwinding device in the unwinding position. The core tube of a reel 3 of paper is secured between chucks 6 and 7 and is secured when lifted in such a way that it can rotate freely by supporting arms 4 and 5. The axis of rotation of reel 3 is for reasons of stability not exactly above shaft 8 but horizontally displaced more or less toward motor 31 into a position b. In the unwinding position, shaft 8 is very close to an under-the-floor conveyor 39 that extends across the web. Web 40 is unwound from reel 3 at the top approximately horizontally in the direction indicated by the arrow.

Figure 4:
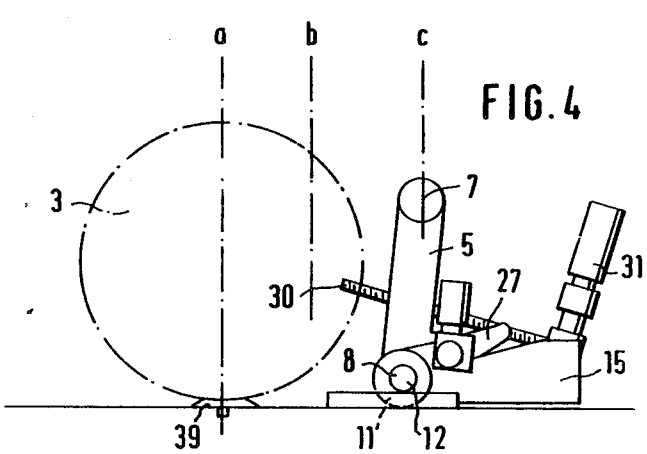
FIGS. 3 through 6 illustrate how a reel is unwound and how a fresh reel is accommodated in the device in FIG. 1, and FIG. 7 and 8 are diagrams illustrating the principle behind a device in accordance with the invention wherein the supporting arms are suspended in stationary uprights.
Figure 6:
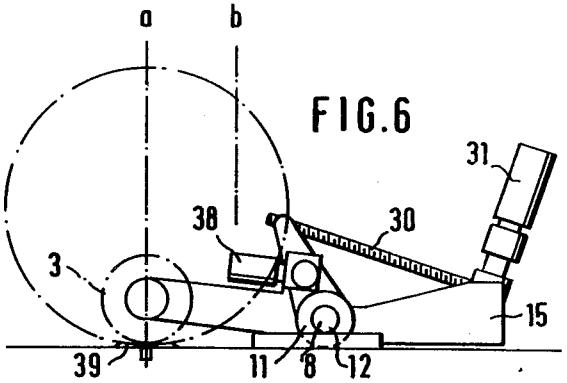
Figure 5:
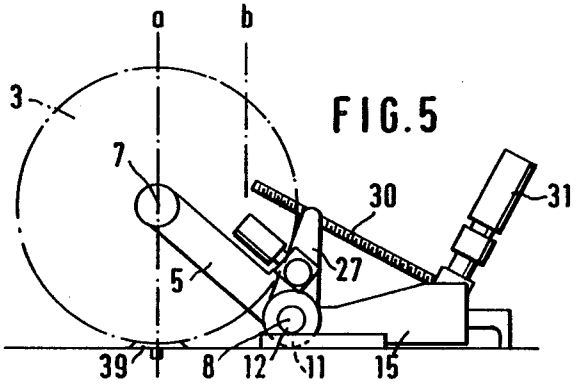

FIGS. 4 through 6 illustrate how a fresh reel 3 is loaded. Once an old reel has been unwound, the device moves away from conveyor 39, toward the right in the figures, and makes room for the conveyor to supply a fresh reel 3. The axis of rotation of chucks 6 and 7 is accordingly in position c. The fresh reel is supplied axially from the side opposite lifting system 29 to 31. Spindle 30 does not get in the way because it is positioned on the take-off side beyond the operating width (FIG. 4).

To accept a fresh reel, chucks 6 and 7 are separated farther than the width of the roll and the empty core tube is removed, which can be done while the fresh reel is being conveyed into the acceptance position. Since the device is freely accessible at the side (on the right in FIG. 4) opposite the reel-introduction side, the empty tube can be removed in that location.

Under-the-floor conveyor 39 moves the reel into the acceptance position only across web 40. It is unnecessary to shift the reel at an angle to that direction.

Once fresh reel 3 has arrived in its axial position between supporting arms 4 and 5, chucks 6 and 7 are positioned coaxially with the reel (FIG. 5) by way of a motion that combines a horizontal motion on the part of the device toward conveyor 39 and a pivoting motion on the part of supporting arms 4 and 5. The combination of horizontal and pivoting motion makes it possible to move chucks 6 and 7 into alignment with any possible position of the axis of the reel, which will be somewhere along line a, depending on the diameter of the reel. FIG. 6 illustrates chucks 6 and 7 in position for accepting a reel with a short diameter.

Once chucks 6 and 7 are coaxial with reel 3, they are introduced into the core tube by bringing supporting arms 4 and 5 together and will accordingly secure the reel. The accordingly secured reel 3 is then lifted into the upper unwinding position by a pivoting motion on the part of supporting arms 4 and 5 and shifted into the horizontal unwinding position b by a horizontal motion on the part of the device as a whole. The unwinding device with the reel tensioned in will at this time be back in the position illustrated in FIG. 3.

Figure 7:
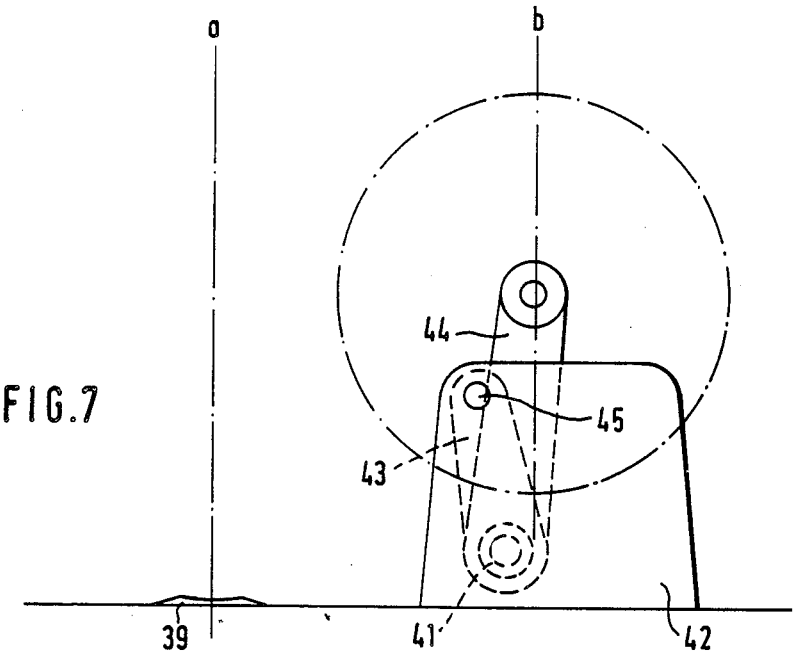
Figure 8:
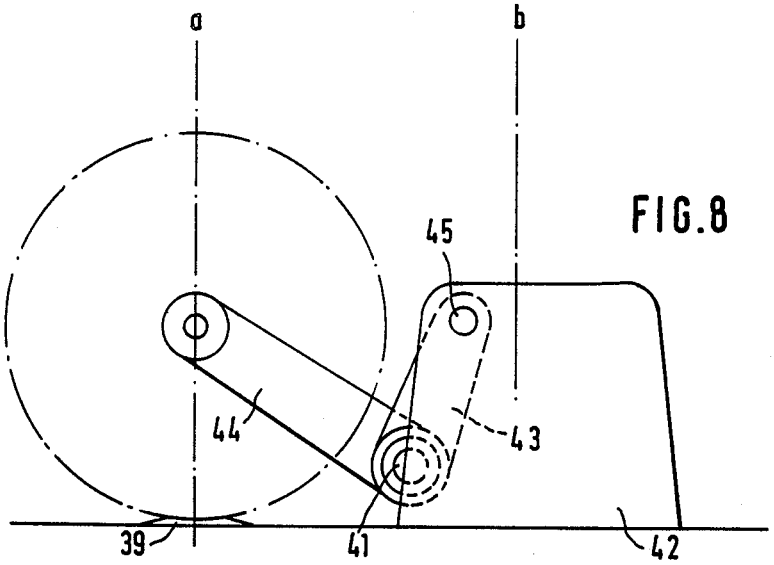

FIGS. 7 and 8 illustrate the principle behind another embodiment of the invention wherein the horizontal motion of a pivoting bearing 41 is accomplished not by moving the device as a whole but due to a double-link suspension of the supporting arms.

This device has a stationary upright 42 on each side of the web. Articulated to each upright 42 is a lever 43. Secured to the end of each lever 43 that is not articulated to an upright 42 is a supporting arm 44 that pivots up on a shaft. Levers 43 can be pivoted around an axis 45 of articulation on uprights 42 and supporting arms 44 can be pivoted independently of levers 43 in bearings 41 on the levers by an unillustrated drive mechanism.

Pivoting bearings 41 are moved horizontally toward under-the-floor conveyor 39 to position the chucks in horizontal acceptance position a by pivoting levers 43 (FIG. 8). The chucks are positioned vertically along line a by the vertical components of the two pivoting motions.

The reel 3 is again lifted and shifted into horizontal unwinding position b (FIG. 7) by the combination of the upward pivoting motion of supporting arms 44 and the pivoting motion of levers 43.

The pivoting bearings 41 on the arms 45 in this embodiment do not move exactly horizontally but along the arc of a circle with a horizontal component.

It will be appreciated that the instant specifications and claims are set forth by way of illustration and not limitation, and that various modifications and changes may be made without departing from the spirit and scope of the present invention.

What is claimed is:

1. In a device for unwinding a web of material from a reel, having two spaced apart supporting arms positioned on two sides of the web, means for pivoting the arms upwardly around an axis of rotation and wherein the arms have means for accommodating and holding the reel for rotation, the improvement wherein the means for pivoting comprises pivoting bearings for the supporting arms and means mounting the bearings for movement between two positions that extend horizontally and are mutually displaced across the axis of rotation, the means for pivoting the supporting arms including a rotating shaft that parallels the axis of rotation of a reel to be wound, means mounting the arms to the shaft to be non-rotatable with respect thereto and means for advancing the shaft horizontally across the axis of rotation of the reel, the advancing means comprising lateral casters and a carriage and a drive mechanism for advancing the carriage.

2. A device as in claim 1, further comprising a pivoting lever secured to the shaft and pivoted by a drive mechanism.

3. A device as in claim 1, wherein the advanceing means comprises an advance-drive mechanism on one side of the shaft, and a synchronizing mechanism to ensure a uniform advance of the shaft parallel to the axis of the reel.

4. A device as in claim 1, wherein the pivoting means for each supporting arm comprises a lever articulated at one end to an upright.

5. A device as in claim 1, further comprising means for varying the distance between the supporting arms.

* * * * *